US005344110A

United States Patent [19]

Scarpa

[11] Patent Number: 5,344,110

[45] Date of Patent: Sep. 6, 1994

[54] HOLDER APPARATUS FOR POSITIONING ARCHERY BOW RELATIVE TO ORTHOGONAL AXES

[76] Inventor: Ralph J. Scarpa, 2 Buffalo St., Hicksville, N.Y. 11801

[21] Appl. No.: 14,714

[22] Filed: Feb. 8, 1993

[51] Int. Cl.[5] ..... A47B 96/06

[52] U.S. Cl. ..... 248/229; 124/86; 269/97

[58] Field of Search ..... 248/229, 309.1; 269/75, 269/97, 135, 909, 71; 124/86

[56] References Cited

U.S. PATENT DOCUMENTS

| | | | |
|---|---|---|---|
| 377,946 | 2/1888 | Leopold | 269/97 |
| 2,019,789 | 11/1935 | Mahannah | 269/97 X |
| 3,055,655 | 9/1962 | Chelf | 269/321 |
| 3,147,005 | 9/1964 | Miller | 269/134 X |
| 4,140,307 | 2/1979 | Dalmav | 269/75 X |
| 4,352,489 | 10/1982 | Wagster | 269/75 X |
| 4,974,576 | 12/1990 | Morey et al. | 124/91 |
| 5,039,052 | 8/1991 | Carafice | 248/309.1 |
| 5,048,504 | 9/1991 | Ballard | 124/86 |
| 5,058,869 | 10/1991 | Ruthven | 269/45 |
| 5,092,572 | 3/1992 | Litwak | 269/71 X |
| 5,121,736 | 6/1992 | Hawk | 124/86 |
| 5,222,473 | 6/1993 | Lint | 124/86 |
| 5,231,970 | 8/1993 | Ploot | 124/86 X |

*Primary Examiner*—J. Franklin Foss
*Attorney, Agent, or Firm*—John R. Flanagan

[57] ABSTRACT

An archery bow holder apparatus includes a table mount block, a clamp mount block, a hinge mounting the clamp mount block to the table mount block for pivotal movement relative thereto about a first horizontal axis, a first adjustment device for releasably holding the clamp mount block at a selected angle relative to the table mount block, a bow mounting block, a pivot pin mounting the bow mounting block to the clamp mount block for pivotal movement relative thereto about a second horizontal axis extending in orthogonal relation to the first horizontal axis, a second adjustment device for releasably holding the bow mounting block at a selected angular position relative to the clamp mount block, and a locking clamp movably mounted to the bow mounting block and being actuatable to releasably lock an archery bow on the bow mounting block.

18 Claims, 2 Drawing Sheets

62
42B
20
10
55
45
42
56
42A
30
58
18
60
38
54
32
14
30B
36
12
40
14A
30A
B
26

20
20A
48
42B
10
50
45
22
42
43
30
D
14A
32
44
42A
44
18
16A
36
14
28
38
C
16
12
40
30A
30B
28
16B
26
B

HOLDER APPARATUS FOR POSITIONING ARCHERY BOW RELATIVE TO ORTHOGONAL AXES

BACKGROUND OF THE INVENTION

1. Field of the Invention

The present invention generally relates to archery servicing equipment and, more particularly, is concerned with a holder apparatus for adjustably positioning an archery bow relative to a pair of orthogonal axes.

2. Description of the Prior Art

Archery bows require frequent adjustment, repair and tuning of their strings and other accessories. During such servicing, the position of the bow needs to be changed from time to time to facilitate making the necessary adjustments.

Different devices are known in the prior art for holding archery bows. Representative of the prior art devices are the ones disclosed in Chelf U.S. Pat. Nos. (3,055,655), Morey et al (4,974,576), Ballard (5,048,504) and Hawk (5,121,736).

However, the holder devices of these patents are designed to hold specific designs of bows for specific purposes, such as sight tuning, storage stand, sight alignment, and bow stringing. None of these devices are designed for holding a wide variety of bow designs for facilitating various activities involved in servicing of bows.

Consequently, a need exists for improvement of bow holders so as to overcome the problems of the prior art.

SUMMARY OF THE INVENTION

The present invention provides an archery bow holder apparatus designed to satisfy the aforementioned need. The holder apparatus of the present invention is adapted for positioning an archery bow relative to a pair of orthogonal axes in a manner which facilitates quick and easy changing of the position of the bow relative to the orthogonal axes for performing various servicing activities.

Accordingly, the present invention is directed to an archery bow holder apparatus which comprises: (a) a first support member stationarily mountable to a support structure; (b) a second support member mounted to the first member for pivotal movement relative thereto about a first pivotal axis; (c) first adjustable means for holding the second support member at a selected angular position relative to the first support member; (d) a bow support member mounted to the second support member for pivotal movement relative thereto about a second pivotal axis extending in a orthogonal relationship to the first pivotal axis; (e) second adjustable means for holding the bow support member at a selected angular position relative to the second support member; and (f) clamping means mounted to the bow support member for releasably locking an archery bow on the bow support member.

More particularly, the first adjustable means includes a first bracket attached to one of the first and second support members and having an arcuate shaped slot concentric about the first pivotal axis, and a first fastener extending through the slot of the first bracket and being attached to the other of the first and second support members and adjustable relative to the first bracket for tightening and untightening the bracket against and from the other of the first and second support members. The second adjustable means includes a second bracket attached to the second support member and having an arcuate shaped slot concentric about the second pivotal axis, and a second fastener extending through the slot of the second bracket and being attached to the bow support member and adjustable relative to the second bracket for tightening and untightening the second bracket against and from the bow support member.

Further, the bow support member has a concave-shaped surface facing toward the clamping means. Also, the bow support member has a layer of resiliently compressible material applied on the concave-shaped surface.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
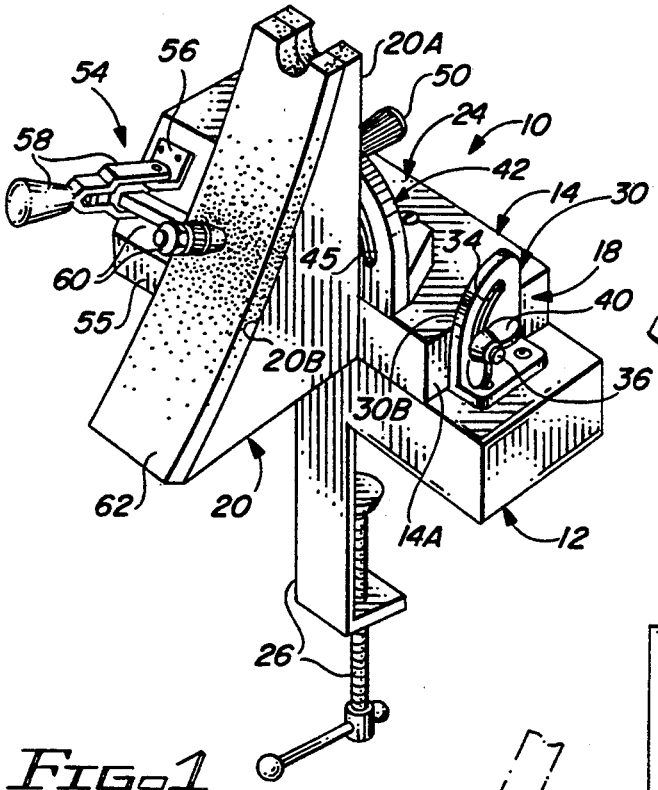
FIG. 1 is a perspective view of an archery bow holder apparatus of the present invention.
Figure 3:
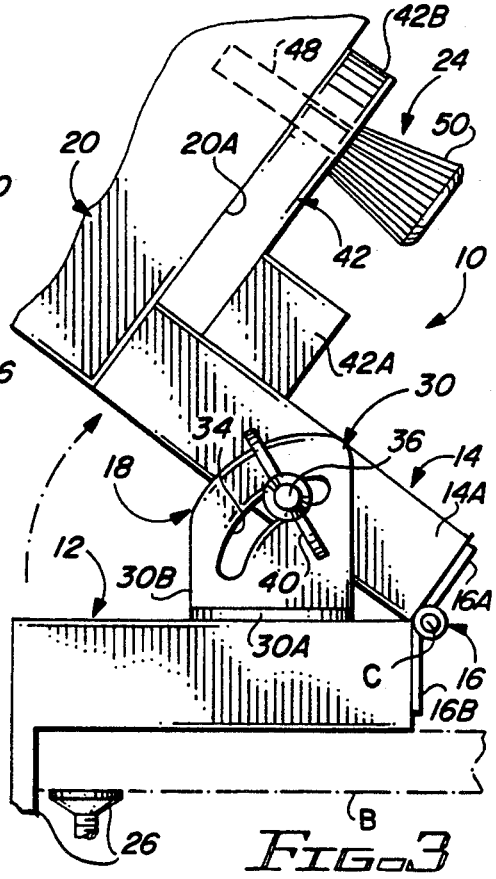
FIG. 3 is a fragmentary view of the holder apparatus similar to that of FIG. 2 but with a clamp mount block of the apparatus rotated from the horizontal position of FIG. 2 to an inclined position relative to a first of a pair of horizontal orthogonal axes.

Referring to the FIGS. 1 to 5 of the drawings, there is illustrated an archery bow holder apparatus of the present invention, generally designated 10, for holding an archery bow A for servicing. The archery bow holder apparatus 10 basically includes a first support member 12, a second support member 14, a pivotal hinge 16, a first adjustable means 18, a bow support member 20, a pivot pin 22, and a second adjustable means 24.

As an example, the first support member 12 can take the form of a table or bench mount block 12. The table mount block 12 is stationarily mounted to a support structure, such as an edge portion of a work table or bench B, by a conventional C-shaped clamp 26. As an example, the second support member 14 can take the form of a clamp mount block 14. The clamp mount block 14 is pivotally mounted to the table mount block 12 by the pivotal hinge 16. The upper and lower parts 16A, 16B of the hinge 16 are rigidly connected respectively to the table and clamp mount blocks 12, 14 by a plurality of screws 28. The hinge 16 permits pivotal movement of the clamp mount block 14 relative to the table mount block 12 about a first pivotal horizontal axis C defined by the hinge 16.

The first adjustable means 18 is operable for holding the clamp mount block 14 at a desired selected angular position relative to the table mount block 12. The first adjustable means 18 includes a first bracket 30 and a first fastener 32.

The first bracket 30 takes the form of a plate 30 having a base portion 30A attached upon one end of the table mount block 12 and an upright portion 30B integrally connected with and extending upright from and in transverse relation to the base portion 30A. The upright portion 30B of the first bracket 30 has an arcuate-shaped slot 34 extending concentric about the first pivotal axis C.

The first fastener 32 includes an elongated threaded stud 36, an annular flat washer 38 inserted over the stud 36, and a wing nut 40 threaded on an outer end of the stud 36. The threaded stud 36 is threadably anchored to an end face 14A of the clamp mount block 14 and extends outwardly through the arcuate slot 34 of the first bracket 30 located adjacent thereto. The clamp mount block 14 can be pivoted relative to the table mount block 12 and set at any selected angular position between the horizontal position of FIG. 2 and the inclined position of FIG. 3 by tightening and untightening the wing nut 40 relative to the first bracket 30 for tightening and untightening the upright portion 30B of the first bracket 30 against and from the end face 14A of the clamp mount block 14.

The bow support member 20 is pivotally mounted to the clamp mount block 14 by the pivot pin 22 which is attached to a second bracket 42 of the second adjustable means 24 and rotatably seated in a bore 43 defined in a rear surface 20A of the bow support member 20. The pivot pin 22 permits pivotal movement of the bow support member 20 relative to the clamp mount block 14 and second bracket 42 about a second pivotal horizontal axis D extending in orthogonal relationship to the first pivotal horizontal axis C.

The second bracket 42 has a base portion 42A attached upon the clamp mount block 14 by a pair of bolts 44 and an upright portion 42B integrally connected with and extending upright from and in transverse relation to the base portion 42A. The upright portion 42B of the second bracket 42 has an arcuate-shaped slot 45 extending concentric about the second pivotal axis D.

The second adjustable means 24 also includes a second fastener 46. As an example, the second fastener 46 can take the form of an elongated threaded stud 48 extending through the slot 45 and having a knob 50 on its outer end. The inner end of the threaded stud 48 is threaded into a hole 52 tapped in the rear surface 20A of the bow support member 20. The bow support member 20 can be pivoted relative to the second bracket 42 and the clamp mount block 14 in the direction of the arrows in FIG. 4 and set at any selected angular position on either side of vertical by tightening and untightening the second fastener 46 by turning the knob 50 relative to the second bracket 42 for tightening and untightening the upright portion 42B of the second bracket 42 against and from the rear surface 20A of the bow support member 20.

The holder apparatus 10 also includes a clamping device 54 mounted on a block 55 fixed to a side of the bow support member 20. The clamping device 54, being conventional per se, has a base 56 pivotally mounting a lever arm 58 and a clamp arm 60 which are coupled together such that as the lever arm 58 is pivoted from a vertical position away from the clamp arm 60 the clamp arm is raised from a lower clamping position to an upper releasing position.

Figure 2:
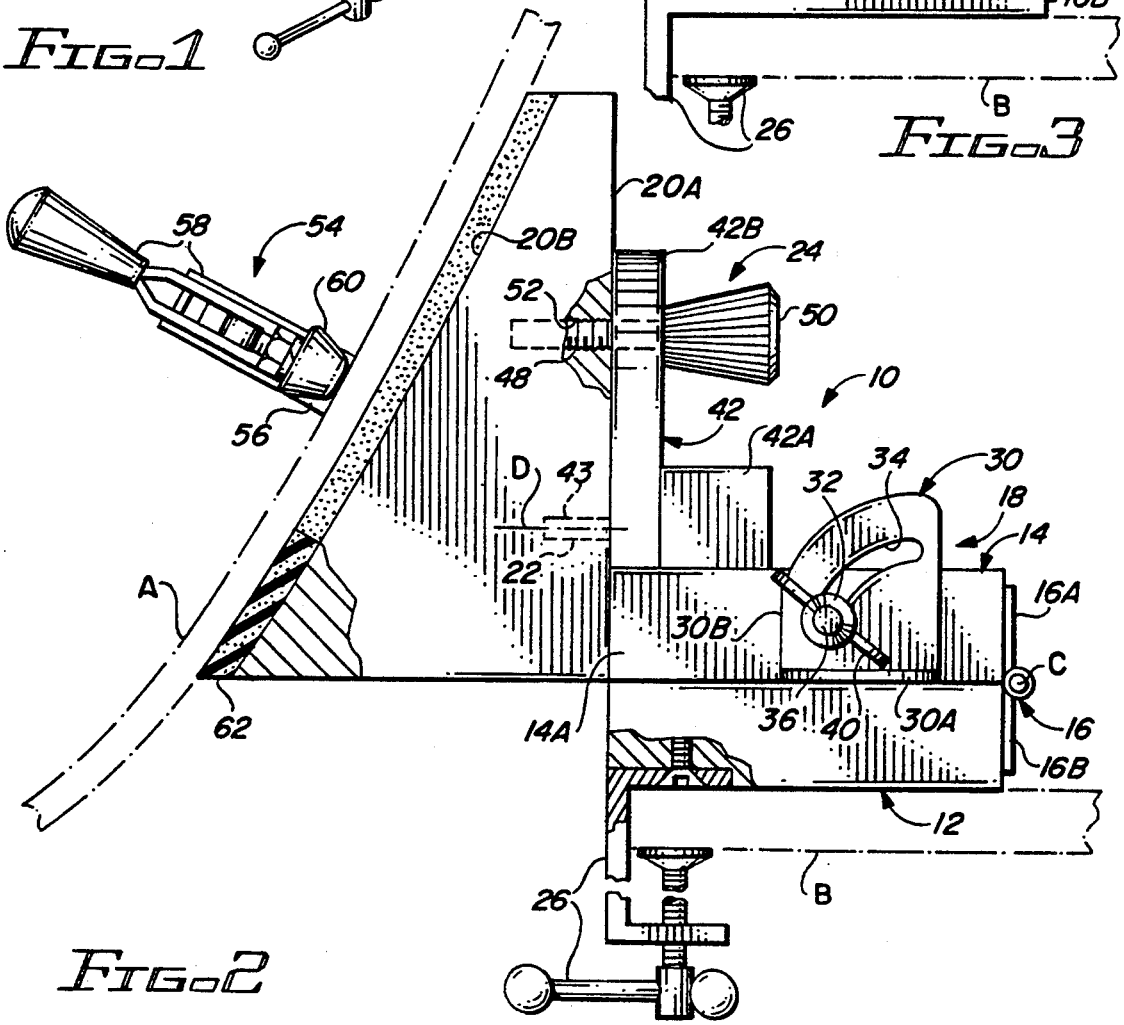
FIG. 2 is an enlarged side elevational view of the holder apparatus of FIG. 1.
Figure 4:
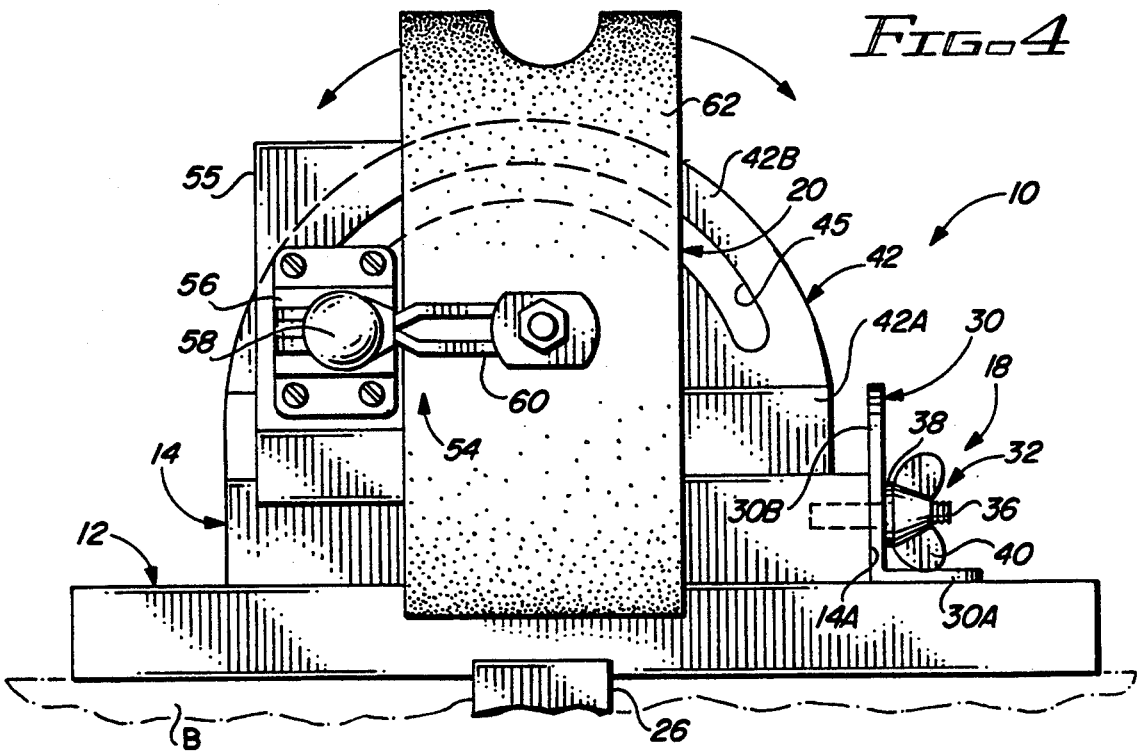
FIG. 4 is an enlarged front elevational view of the holder apparatus of FIG. 1.
Figure 5:
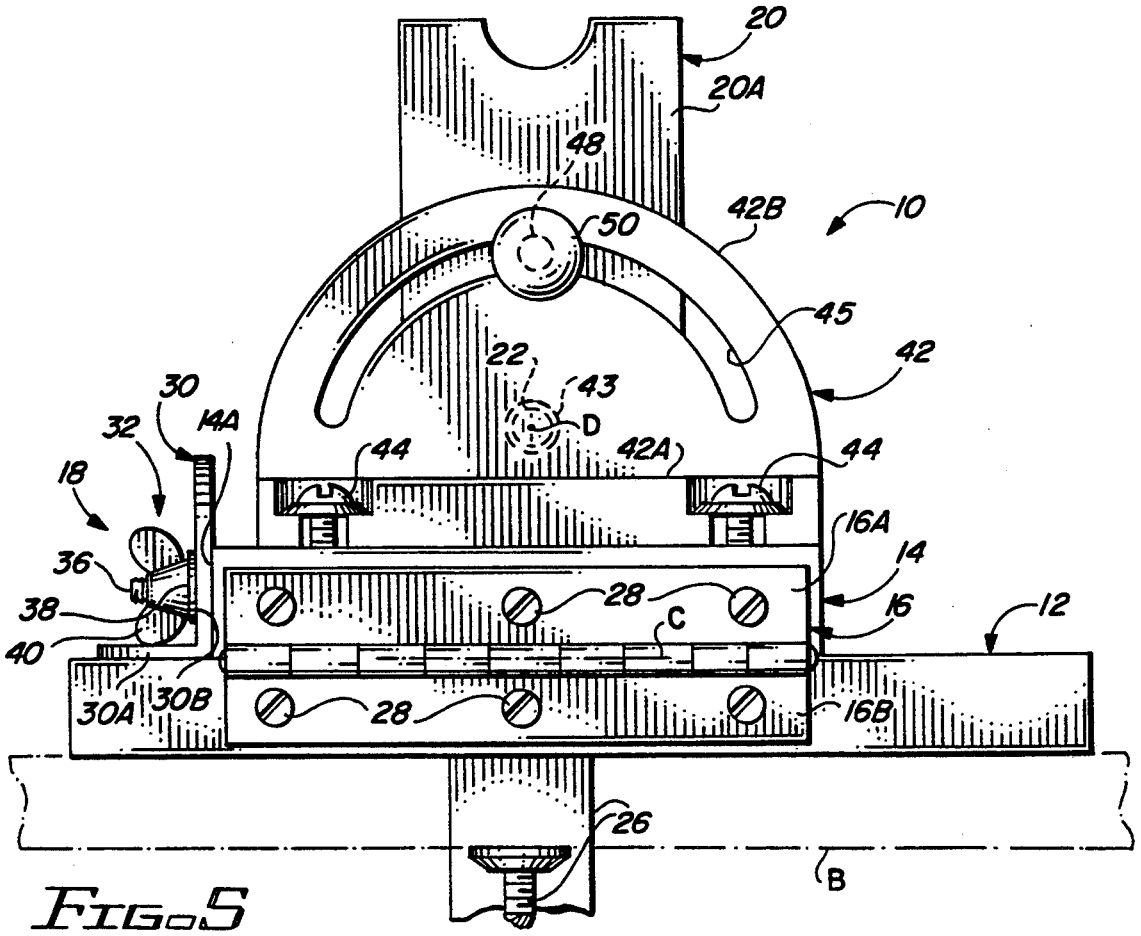
FIG. 5 is an enlarged rear elevational view of the holder apparatus of FIG. 1.

The bow support member 20 has a front concave-shaped surface 20B facing toward the clamp arm 60. The base 56 is mounted along a side of and spaced from and disposed between a pair of opposite ends of the concave-shaped surface 20B of the bow support structure 20. The front surface 20B of the bow support member 20 has a layer 62 of resiliently compressible material, such as rubber, applied thereon for seating an arcuate-shaped portion of the archery bow A. By pivoting the lever arm 58, the clamp arm 60 of the clamping device 54 can be pivoted into contact with the bow A to temporarily hold it against the bow support member 20, as shown in FIG. 2.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. An archery bow holder apparatus, comprising:

(a) a first support member stationarily mountable to a support structure;

(b) a second support member mounted to said first member for pivotal movement relative thereto about a first pivotal axis;

(c) first adjustable means for holding said second support member at a selected angular position relative to said first support member;

(d) a bow support member mounted to said second support member for pivotal movement relative thereto about a second pivotal axis extending in a orthogonal relationship to said first pivotal axis;

(e) second adjustable means for holding said bow support member at a selected angular position relative to said second support member;

(f) clamping means mounted to said bow support member for releasably locking an archery bow on said bow support member; and (g) a hinge pivotally connecting said second support member to said first support member about said first pivotal axis.

2. The apparatus of claim 1 wherein said first support member is an elongated block.

3. The apparatus of claim 1 wherein said second support member is an elongated block.

4. An archery bow holder apparatus, comprising:

(a) a first support member stationarily mountable to a support structure;

(b) a second support member mounted to said first member for pivotal movement relative thereto about a first pivotal axis;

(c) first adjustable means for holding said second support member at a selected angular position relative to said first support member, said first adjustable means including (i) a first bracket attached to one of said first and second support members and having an arcuate shaped slot concentric about said first pivotal axis, and (ii) a first fastener extending through said slot of said first bracket and being attached to the other of said first and second support members and adjustable relative to said first bracket for tightening and untightening said bracket against and from said other of said first and second support members;

(d) a bow support member mounted to said second support member for pivotal movement relative thereto about a second pivotal axis extending in a orthogonal relationship to said first pivotal axis;

(e) second adjustable means for holding said bow support member at a selected angular position relative to said second support member; and (f) clamping means mounted to said bow support member for releasably locking an archery bow on said bow support member.

5. The apparatus of claim 4 further comprising:

a hinge pivotally connecting said second support member to said first support member about said first pivotal axis.

6. The apparatus of claim 1 further comprising:

a pivot pin pivotally connecting said bow support member to said second support member about said second pivotal axis.

7. An archery bow holder apparatus, comprising:

(a) a first support member stationarily mountable to a support structure;

(b) a second support member mounted to said first member for pivotal movement relative thereto about a first pivotal axis;

(c) first adjustable means for holding said second support member at a selected angular position relative to said first support member;

(d) a bow support member mounted to said second support member for pivotal movement relative thereto about a second pivotal axis extending in a orthogonal relationship to said first pivotal axis;

(e) second adjustable means for holding said bow support member at a selected angular position relative to said second support member, said second adjustable means including (i) a second bracket attached to said second support member.and having an arcuate shaped slot concentric about said second pivotal axis, and (ii) a second fastener extending through said slot of said second bracket and being attached to said bow support member and adjustable relative to said second bracket for tightening and untightening said second bracket against and from said bow support member; and (f) clamping means mounted to said bow support member for releasably locking an archery bow on said bow support member.

8. The apparatus of claim 1 wherein said bow support member has a concave-shaped surface facing toward said clamping means.

9. The apparatus of claim 1 wherein said bow support member has a layer of resiliently compressible material applied on said concave-shaped surface.

10. The apparatus of claim 1 wherein said clamping means is a locking device actuatable toward and away from said bow support member between locking and releasing positions relative thereto.

11. An archery bow holder apparatus, comprising:

(a) a table mount block;

(b) a clamp mount block;

(c) a hinge mounting the clamp mount block to the table mount block for pivotal movement relative thereto about a first horizontal axis;

(d) a first adjustment device for releasably holding the clamp mount block at a selected angle relative to the table mount block;

(e) a bow mounting block;

(f) a pivot pin mounting the bow mounting block to the clamp mount block for pivotal movement relative thereto about a second horizontal axis extending in orthogonal relation to the first horizontal axis;

(g) a second adjustment device for releasably holding the bow mounting block at a selected angular position relative to the clamp mount block; and (h) a locking clamp movably mounted to the bow mounting block and being actuatable to releasably lock an archery bow on the bow mounting block.

12. The apparatus of claim 11 wherein said first adjustable means includes:

a first bracket attached to one of said first and second support members and having an arcuate shaped slot concentric about said first pivotal axis; and a first fastener extending through said slot of said first bracket and being attached to the other of said first and second support members and adjustable relative to said first bracket for tightening and untightening said bracket against and from said other of said first and second support members.

13. The apparatus of claim 11 wherein said second adjustable means includes:

a second bracket attached to said second support member and having an arcuate shaped slot concentric about said second pivotal axis; and a second fastener extending through said slot of said second bracket and being attached to said bow support member and adjustable relative to said second bracket for tightening and untightening said second bracket against and from said bow support member.

14. The apparatus of claim 11 wherein said bow support member has a concave-shaped surface facing toward said clamping means.

15. The apparatus of claim 11 wherein said bow support member has a layer of resiliently compressible material applied on said concave-shaped surface.

16. The apparatus of claim 11 wherein said clamping means is a locking device actuatable toward and away from said bow support member between locking and releasing positions relative thereto.

17. An archery bow holder apparatus, comprising:

(a) a table mount structure;

(b) means attached to said table mount structure for releasably and stationarily attaching said table mount structure to a support structure;

(c) a bow support structure mounted to said table mount structure and having an elongated concave-shaped surface defined thereon being adapted to receive and seat an arcuate-shaped portion of an archery bow thereon; and (d) clamping means having a base mounted along a side of, and spaced from and disposed between a pair of opposite ends of, said concave-shaped surface of said bow support structure and an arm pivotally mounted to said base and being movable relative thereto between a raised releasing position away from said surface on said bow support structure and a lowered clamping position adjacent to said surface on said bow support structure in which said arm is adapted to engage and releasably hold the arcuate-shaped portion of the archery bow thereon against said concave-shaped surface of said bow support structure.

18. The apparatus of claim 17 wherein said bow support structure has a layer of resiliently compressible material applied on said concave-shaped surface.

* * * * *